United States Patent [19]

Palomino, Jr.

[11] Patent Number: 5,074,008

[45] Date of Patent: Dec. 24, 1991

[54] DUST MOP ATTACHMENT FOR VACUUM CLEANERS

[76] Inventor: Guillermo Palomino, Jr., P.O. Box 2793, Greenfield, Calif. 93927

[21] Appl. No.: 703,489

[22] Filed: May 21, 1991

[51] Int. Cl.[5] ..... A47L 9/06

[52] U.S. Cl. ..... 15/403; 15/393

[58] Field of Search ..... 15/393, 396, 227, 228, 15/403

[56] References Cited

U.S. PATENT DOCUMENTS

| | | | |
|---|---|---|---|
| 1,759,691 | 5/1930 | Gleason | 15/403 |
| 1,759,692 | 5/1930 | Gleason | 15/403 |
| 1,978,579 | 10/1934 | Hooks | 15/403 |
| 2,064,903 | 12/1936 | Ghignatti | 15/403 X |

FOREIGN PATENT DOCUMENTS

| | | | |
|---|---|---|---|
| 100161 | 2/1937 | Australia | 15/403 |
| 137078 | 6/1948 | Australia | 15/403 |
| 850321 | 9/1939 | France | 15/403 |

*Primary Examiner*—Chris K. Moore

*Attorney, Agent, or Firm*—Jeffrey A. Hall

[57] ABSTRACT

A mop adapted for attachment to a vacuum cleaner comprising a frame member and a mop element detachably secured to said frame member by a plurality of snap fasteners. The mop element has an opening therein adapted to receive a vacuum cleaner's nozzle, suction head, or other attachment. The mop element may be further secured to said frame member by a pair of hook and loop material fastening straps. In the preferred embodiment said straps are sewn onto the mop element and provide for convenient attachment and removal of the mop element from the frame member.

19 Claims, 2 Drawing Sheets

DUST MOP ATTACHMENT FOR VACUUM CLEANERS

BACKGROUND OF THE INVENTION

1. Field of Invention

This invention relates to attachments adapted for attachment to the suction head of vacuum cleaners and particularly to dust mop attachments for use in combination with a vacuum cleaner.

2. Description of Prior Art

Many, if not most users of vacuum cleaners find that many objects cannot be adequately cleaned with the standard attachments to vacuum cleaners, such as dust and dirt on walls, fine furniture, and various fragile objects. Furthermore, there is no satisfactory means to utilize the vacuum cleaner's suction to polish and clean objects such as hard floors, walls, furniture, and fragile objects such as artwork, antiques, and the like.

Heretofore a wide variety of attachments have been proposed an implemented for attachment onto the suction head of a vacuum cleaner for various cleaning functions.

Prior attempts to solve these problems have been inadequate and have not provided for attachments which may be easily removed from the vacuum and cleaned, nor for suitable means for positioning and immobilizing the vacuum suction head in a position for optimal cleaning and polishing functions. See, for example of this genre, U.S. Pat. Nos. 1,040,176, 1,674,393, 1,752,034, 1,759,691, 1,759,692, 1,838,481, 1,978,579, 1,992,986, 2,064,903, 2,214,989, 2,584,515, and 2,599,420.

Most users, therefore, would find it desirable to have a detachable mop attachment for vacuum cleaners which is simple to attach or detach from the vacuum, easy and convenient to clean, useful in combination with a wide variety of vacuum cleaning attachments, while providing a very efficient and versatile cleaning mechanism.

SUMMARY OF THE INVENTION

Accordingly I claim the following as the objects and advantages of the invention: to provide a mop adapted for attachment to a nozzle, suction head, or any conventional vacuum attachment which is simple to attach or detach from said vacuum apparatus, to provide such a mop which requires a minimum of skill and training to use, to provide such a mop attachment having a frame member from which said mop can be easily detached, cleaned, or treated, and then simply snapped back on the frame for further use, and to provide such a mop which can do a complete job of cleaning, dusting, and polishing on a wide variety of surfaces and objects.

In addition I claim the following additional objects and advantages; to provide such a mop attachment for vacuum cleaners which acts synergistically with various conventional vacuum attachments such as a brush attachment, to provide such a mop having a plurality of cleaning strands of various lengths, to provide such a mop which may be conveniently and cooperatively treated with substances to enhance cleaning, dusting, and polishing potential, and to provide such a mop which can be adjusted for cleaning, dusting, and polishing a wide variety of surfaces and objects.

In accomplishing these and other objects and advantages a mop adapted for attachment to a vacuum nozzle, suction head, or any conventional vacuum attachment apparatus is provided comprising a frame member, a mop element secured to said frame member, means for detachably securing said mop element to said frame member, an opening in said mop element adapted to receive said nozzle of said vacuum cleaner, and means for detachably securing the nozzle or other vacuum attachment to the mop element.

The frame member may configured in various ways with a rectangular shape being preferred and may be composed of any metal, plastic, composite or the like, with aluminum being preferred.

Means for detachably securing said mop element to said frame member may be by any mechanical means or adhesives with a plurality of mating snaps secured to both the frame member and to the mop element being preferred. The mop element has a plurality of cleaning strands of different length, preferably the shorter strands are situated near the opening of the mop element and the longer strands at a greater distance from the opening so they will not clog or interfere with the suction from the vacuum nozzle, suction head, or other attachment.

The opening in said mop element is preferably of elongated elliptical configuration to readily receive a wide variety of vacuum nozzle, suction head, or other attachments. To further secure said vacuum nozzle, suction head, or attachment to said mop element a pair of hook and loop fastening material straps are sewn onto the mop element. However, any conventional fastening means well known in the art may be used. The vacuum nozzle, suction head, or attachment may be further secured to said frame member by bolts, screws, rivets, or any other mechanical fastening means well known in the art.

Readers will find further objects and advantages of the invention from a consideration of the ensuing description and the accompanying drawings.

DRAWING REFERENCE NUMERALS

Figure 1:
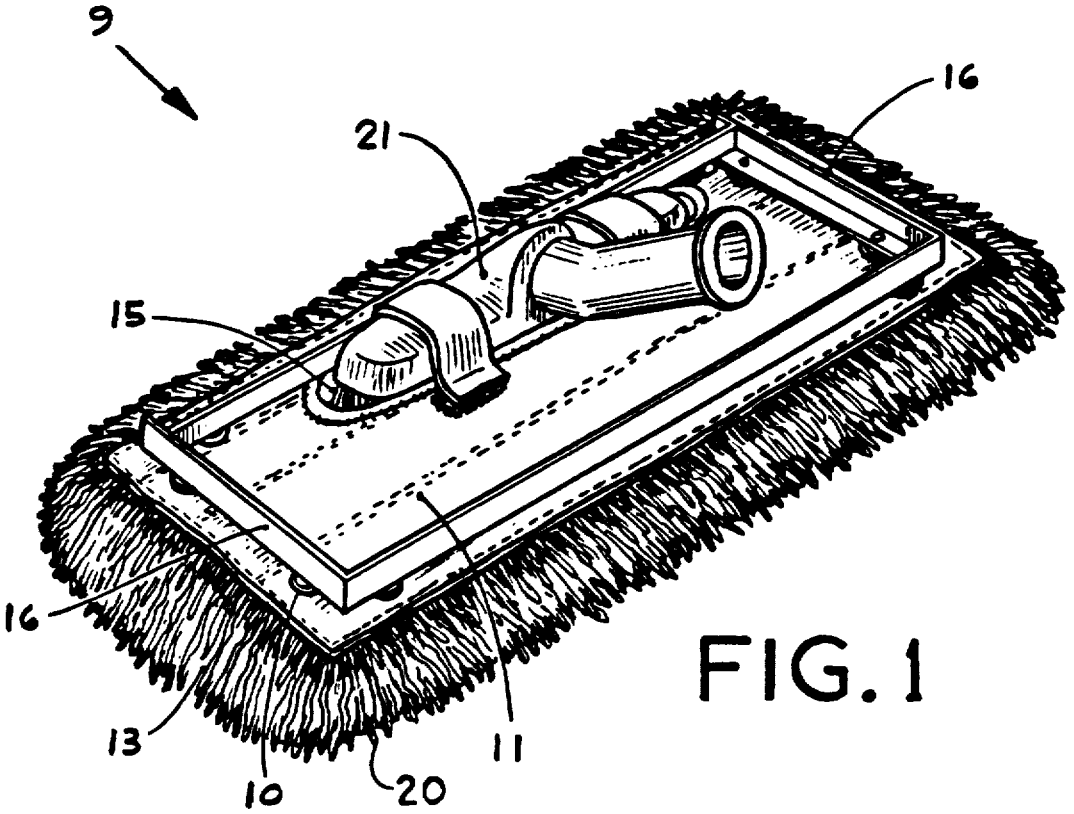
FIG. 1 shows a top perspective view of a dust mop attachment for a vacuum cleaner according to the invention.

9: dust mop attachment for vacuum cleaner
10: snap fasteners
11: fabric
12: hook and loop fastening material straps
13: mop element
14: bolts
15: vacuum brush attachment
16: frame member
17: vacuum tube
18: vacuum hose
19: rivets
20: cleaning strands of mop element 13
21: vacuum suction head or nozzle
22: opening in mop element 13

DETAILED DESCRIPTION OF THE PREFERRED EMBODIMENT OF THE INVENTION

FIG. 1 shows a dust mop attachment 9 for a vacuum cleaner according to the preferred embodiment of the invention. The mop attachment 9 comprises a frame member 16 having a mop element 13 secured thereto preferably by a plurality of snap fasteners 10 secured by rivets 19, however other mechanical fastening means may also be used such as screws, bolts, adhesives, or the like. Mop element 13 has a fabric top section 11 having an opening 22 therein, preferably of a substantially elliptical configuration and a plurality of cleaning strands 22 attached thereto. In the preferred embodiment cleaning strands 22 are of different length with shorter length strands massed around opening 22 and longer strands at a distance from opening 22 and vacuum nozzle or suction head 21 so that they will not clog or interfere with the operation of said vacuum suction head or nozzle 21 or vacuum attachment 15.

A pair of hook and loop fastening material straps 12 are preferably sewn onto mop element 13 and may be used to secure vacuum attachment 15 or vacuum suction head or nozzle 21 to mop element 13. Typically vacuum suction head or nozzle 21 will be secured to a vacuum tube 17 connected to vacuum hose 18 of the vacuum cleaner. Alternatively, one or a plurality of such straps 12 may be used to secure vacuum attachment 15 or vacuum suction head or nozzle 21 to mop element 15 or other mechanical fastening means well known in the art may be substituted therefore. If desired, bolts 14 may be used to further secure vacuum attachment 15 to frame member 16.

Figure 2:
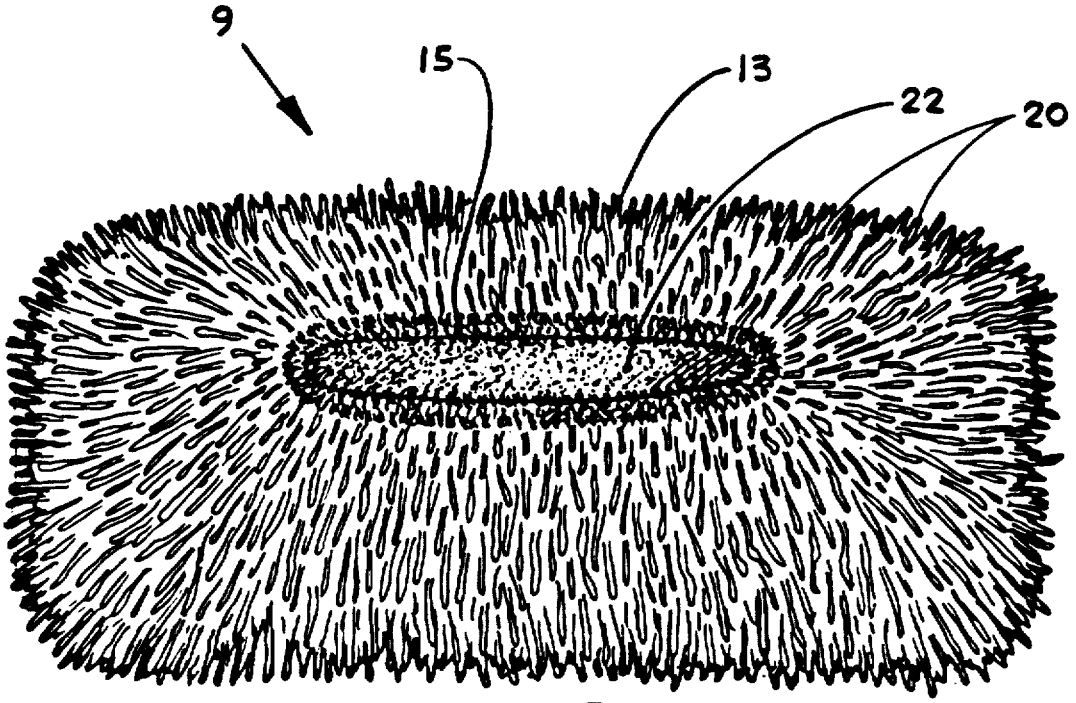
FIG. 2 shows a bottom view of such mop attachment for a vacuum cleaner according to the invention.

Referring now to FIG. 2 a bottom view of dust mop attachment 9 is illustrated. Cleaning strands 20 surround vacuum attachment 15 (here, a brush) and opening 22 in mop element 13. Opening 22 is preferably elliptical in shape. Frame member 16 is preferably rectangularly shaped but may be otherwise, and may be composed metal, plastic, composites, or the like, with aluminum being preferred.

Figure 3:
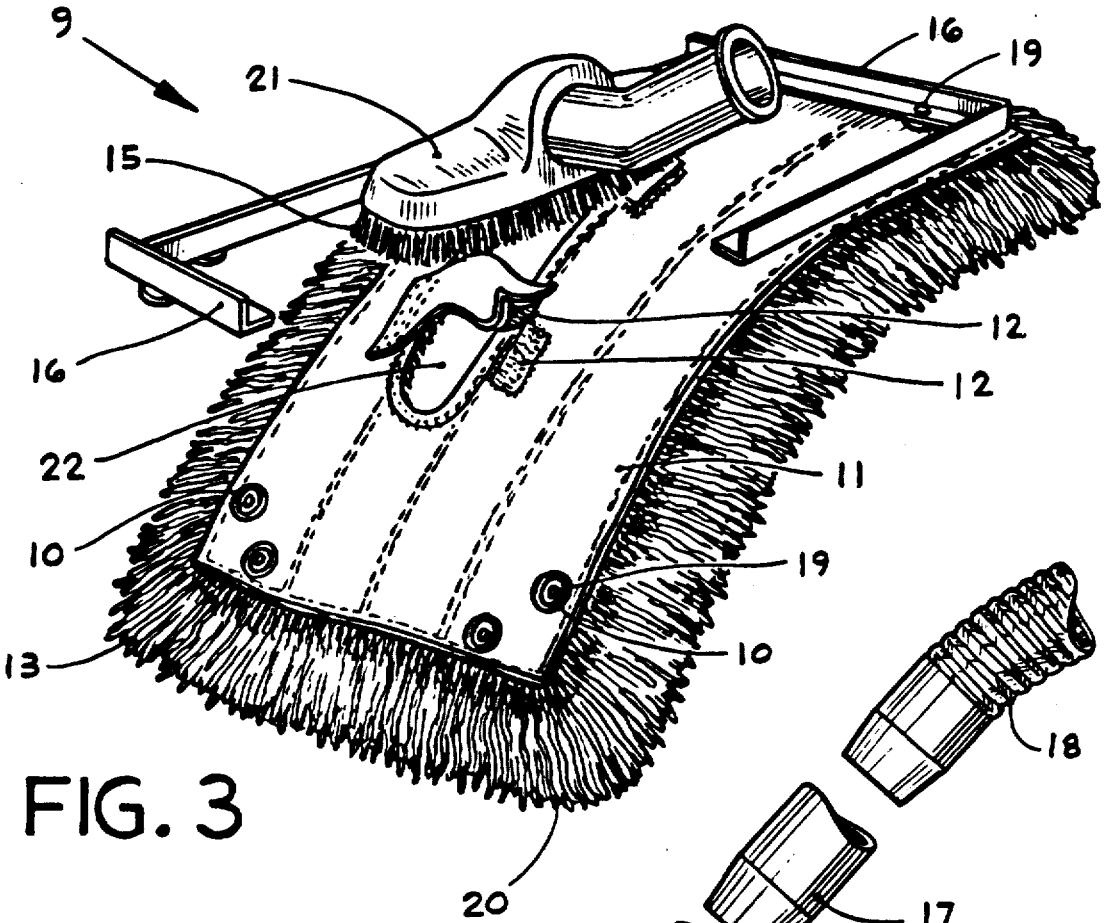
FIG. 3 shows an elevation, perspective view of such a mop attachment for a vacuum cleaner with the mop element partially detached from the frame member.

In reference now to FIG. 3 in which an elevational, perspective view of dust mop attachment 9 is illustrated, vacuum attachment 15 is secured to mop element 13 and frame member 16 by hook and loop fastening material straps 12. Also shown are snap fasteners 10 securing mop element 13 to frame member 16.

Figure 4:
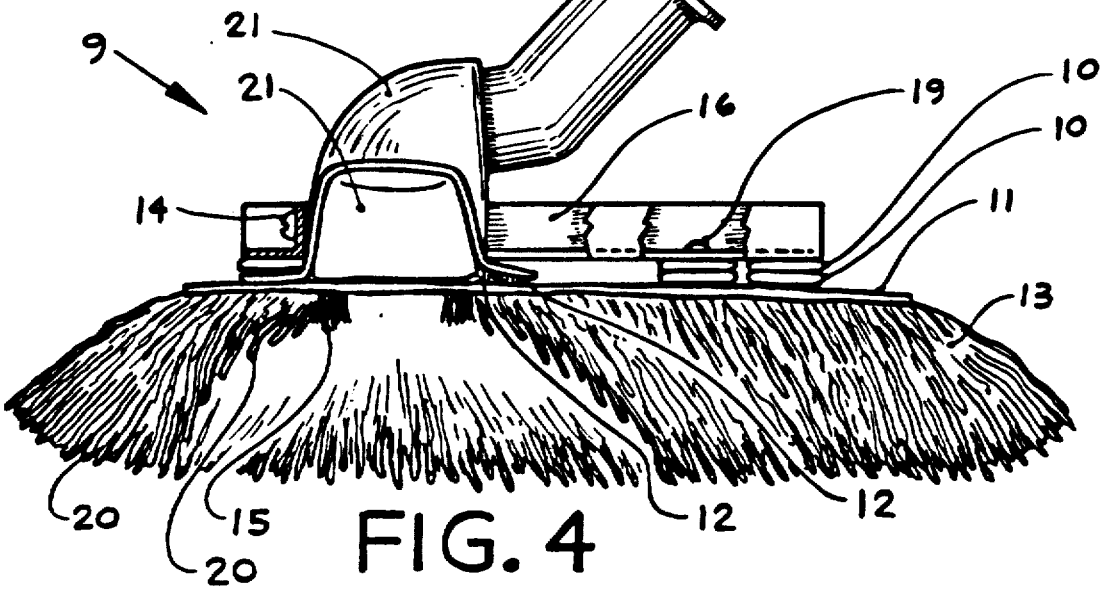
FIG. 4 shows an end view of such mop attachment for a vacuum cleaner according to the invention.

Referring now to FIG. 4 where an end view of dust mop attachment 9 is shown with vacuum tube 17 attached to vacuum attachment 15 which is fastened by straps 12 to mop element 15 with cleaning strands 20 coupled to frame 16.

In operation and use dust mop attachment 9 performs a wide variety of cleaning, dusting and polishing functions. The user simply secures vacuum attachment 15, which is illustrated in FIGS. 1-4 as a brush attachment, to mop element 13 by straps 12, and then activates the vacuum cleaner. The cleaning strands 20 of mop element 13 may be coated with a cleaning or polishing enhancing substance such as paraffin for example, that facilitates cleaning, dusting, and polishing sensitive surfaces or objects without scratching.

If the user desires to clean mop element 13 snaps 10 are simply unfastened from the corresponding snap on frame member 16 and mop element 13 is easily removed for cleaning, treatment, or the like.

To secure frame member 16 to mop element 13 snaps 10 on frame member 16 and the corresponding snaps 10 on mop element 13 are fastened together. To secure vacuum suction head or nozzle 21 with vacuum attachment 15 to mop element 13 the user simply secures hook and loop fastening straps 12 over vacuum attachment 15. Bolts 14 may be used to further secure the vacuum suction head or nozzle 21 or vacuum attachment 15 to frame member 16.

While the above description contains many specificities these should not be construed as limitations on the scope of the invention, but merely as exemplifications of preferred embodiments thereof. Those skilled in the art will envision many other possible variations are within its scope. Accordingly the scope of the invention should be determined by the appended claims and their legal equivalents, and not by the examples which have been given.

I claim:

1. A mop adapted for attachment to a nozzle of a vacuum cleaner comprising:
   - a frame member,
   - a mop element secured to said frame member,
   - means for detachably securing said mop element to said frame member,
   - an opening in said mop element adapted to receive said nozzle of said vacuum cleaner, and
   - means for detachably securing the nozzle of the vacuum cleaner to the mop element.

2. The mop of claim 1 wherein said frame member is rectangularly shaped.

3. The mop of claim 2 wherein said frame member is composed of aluminum.

4. The mop of claim 1 wherein said means for detachably securing said mop element to said frame member comprises a plurality of mating snaps secured to said frame member and to said mop element.

5. The mop of claim 1 wherein said opening in said mop element is substantially elliptical.

6. The mop of claim 1 wherein said means for detachably securing said nozzle of said vacuum cleaner to said mop element comprises a pair of hook and loop fastening material straps.

7. The mop of claim 6 wherein said pair of hook and loop fastening material straps are sewn onto said mop element.

8. The mop of claim 1 wherein said vacuum nozzle is further secured to said frame member by bolts.

9. The mop of claim 1 wherein said mop element has a plurality of cleaning strands of differing length.

10. An improved dust mop attachment for vacuum cleansers of the type having a suction head and hose member, wherein said improvement comprises,
   - a frame member;
   - a mop element secured to said frame member;
   - means for detachably securing said mop element to said frame member; and
   - means for detachably securing said suction head of said vacuum cleaner to the mop element.

11. The improved dust mop attachment for vacuum cleaners of claim 10 wherein said frame member is rectangularly shaped.

12. The improved dust mop attachment for vacuum cleaners of claim 11 wherein said frame member is composed of aluminum.

13. The improved dust mop attachment for vacuum cleaners of claim 10 wherein said mop element has an opening therein adapted to receive said suction head of said vacuum cleaner.

14. The improved mop attachment for vacuum cleaners of claim 13 wherein said opening is substantially elliptical.

15. The improved dust mop attachment for vacuum cleaners of claim 10 wherein said means for detachably securing said mop element to said frame member comprises a plurality of mating snaps secured to said frame member and to said mop element by rivets.

16. The improved mop attachment for vacuum cleaners of claim 10 wherein said means for detachably securing said suction head of said vacuum cleaner to said mop element comprises a pair of hook and loop fastening material straps.

17. The improved mop attachment for vacuum cleaners of claim 16 wherein said pair of hook and loop fastening material straps are sewn onto said mop element.

18. The improved mop attachment for vacuum cleaners of claim 10 wherein said suction head of said vacuum cleaner is further secured to said frame member by bolts.

19. The improved mop attachment for vacuum cleaners of claim 10 wherein said mop element has a plurality of cleaning strands of differing length.

* * * * *